US006122768A

United States Patent [19]

McCrane

[11] Patent Number: 6,122,768

[45] Date of Patent: Sep. 26, 2000

[54] JOINT PROTECTOR FOR USE IN ACTIVE SPORTS

[76] Inventor: David P. McCrane, 35 Executive Ct., Napa, Calif. 94558

[21] Appl. No.: 08/838,407

[22] Filed: Apr. 7, 1997

[51] Int. Cl.[7] ..... A41D 13/06; A41D 13/08

[52] U.S. Cl. ..... 2/16; 2/22

[58] Field of Search ..... 2/22, 23, 24, 16, 2/455, 456

[56] References Cited

U.S. PATENT DOCUMENTS

| | | | |
|---|---|---|---|
| 2,553,612 | 5/1951 | Taylor | 2/22 |
| 4,120,052 | 10/1978 | Butler | 2/16 |
| 5,220,691 | 6/1993 | Wiegers | 2/22 X |
| 5,255,391 | 10/1993 | Levine | 2/24 |
| 5,373,584 | 12/1994 | Parcells | 2/2 |
| 5,405,312 | 4/1995 | Jacobs | 2/22 X |
| 5,410,756 | 5/1995 | Hutson | 2/22 X |
| 5,416,924 | 5/1995 | Sims | 2/22 |
| 5,450,625 | 9/1995 | Hu | 2/22 X |
| 5,594,954 | 1/1997 | Huang | 2/24 |
| 5,611,080 | 3/1997 | Skottheim | 2/16 |
| 5,628,063 | 5/1997 | Reed | 2/22 |
| 5,711,029 | 1/1998 | Visco et al. | 2/24 |

*Primary Examiner*—Michael A. Neas

*Attorney, Agent, or Firm*—Flehr Hohbach Test Albritton & Herbert LLP; Richard E. Backus

[57] ABSTRACT

A joint protector for protecting a human user's knee or elbow from injury. The protector is comprised of a cushion pad which is shaped to fit about portions of the user's knee or elbow. A cap is fitted about the outer surface of the cushion pad and a flexible cover overlies the outer face of the cap. In one embodiment a support carries a cup-shaped cap that is formed of an elastic, compliant material. The cap elastically deforms, responsive to forces impacting on a small area, in an amount sufficient to spread the forces over a flat area as the forces are transferred into and absorbed by the cushion pad. The cap returns to its initial shape when the impact forces are removed. A mechanism is provided for removably attaching the joint protector to the user's knee or elbow joint.

1 Claim, 4 Drawing Sheets

JOINT PROTECTOR FOR USE IN ACTIVE SPORTS

BACKGROUND OF THE INVENTION

1. Field of the Invention

This invention relates in general to protective devices for use in protecting joints such as elbows and knees of users engaged in active sports, for example in-line skating, skateboarding, roller skating, snowboarding and the like.

2. Description of the Related Art

Protective devices such as knee and elbow pads are commonly used in active sports to protect the user's joints from bodily injury during falls onto pavements or against other hard surfaces. The conventional knee and elbow pad designs comprise three principal components. One component is a cushion pad made of a foam material or the like which lies over the knee or elbow. Another component is a fabric covering, such as an elastic sleeve, which fits around the top of the cushion pad and around the back of the joint. The third component is rigid cup-shaped wear cap that fits over the fabric covering in front of the knee or elbow. The wear cap is typically formed of a hard, durable and rigid material which is intended to dissipate some of the energy impacting upon the protective device during a fall. In certain industrial applications, such for use by floor installers or aircraft baggage handlers, the wear cap is replaced by a softer, flexible non-skid or non-sliding cap.

U.S. Pat. No. 5,416,924 to Sims discloses a protective pad adapted to fit about a knee or elbow. The pad includes an inner foam layer, a rigid metal shield affixed to the foam layer, a neoprene layer coated on the outer surface of the shield, and a nylon cover about the neoprene layer. Straps are employed to secure the device about the knee or elbow. One disadvantage of this device is when it hits a hard surface during a fall the impact causes point loading on the unyielding metal shield. Point loading means that the impact forces are concentrated at a relatively small area at the point of impact. This point loading would not only tend to shred the nylon cover but would also tend to tear through the leg of any pants that may be worn over the protector.

U.S. Pat. No. 5,255,391 to Levine provides a knee pad comprising a foam member covered by a fabric patch which in turn is stitched to a body portion. The patent describes the body portion as being fabricated from an elastic material, for example neoprene. Such a device has no protective cap and thus would not provide sufficient protection from the aggressive forces encountered during a fall by users engaged in active sports which include in-line skating and skateboarding.

U.S. Pat. No. 4,120,052 to Butler provides a knee and/or elbow protector in which a cushion pad is sandwiched between an inner fabric sleeve and an outer fabric panel. Plastic protective panels are fitted over the outer panel and woven elastic tapes are then secured to the plastic panel by stitching. Such a device would be vulnerable to the problem of point loading during falls, as discussed above.

The need has therefore been recognized for a joint protector which obviates the foregoing and other limitations and disadvantages of the prior art knee and elbow pad protectors. Despite the various knee and elbow pad protectors in the prior art, there has heretofore not been provided a suitable and attractive solution to these problems.

OBJECTS AND SUMMARY OF THE INVENTION

It is a general object of the present invention to provide a new and improved joint protector for protecting the joints of users engaged in active sports such as in-line skating, skateboarding, roller skating, snowboarding and the like.

Another object is to provide a joint protector of the type described which obviates or minimizes the problem of point loading that can occur when a protector is impacted with aggressive forces during a fall.

Another object is to provide a joint protector of the type described which, during a fall, minimizes the risk of injury to the user and damage to the joint protector as well as the fabric of any pants worn by the user over the protector.

The joint protector of the invention in summary comprises a cushion pad which is shaped for fitting about either the user's knee or elbow. A semi-rigid cap is fitted about a portion of the outer surface of the cushion pad, and a flexible cover is positioned over the cap's outer face. The cap is cup-shaped and is formed of an elastic, compliant material. In response to forces impacting at a small area, a portion of the cap elastically deforms in an amount sufficient to spread the forces over an area as they are transferred into the cushion pad. The deformed portion of the cap resiliently returns to its initial shape when the impact forces are removed.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1:
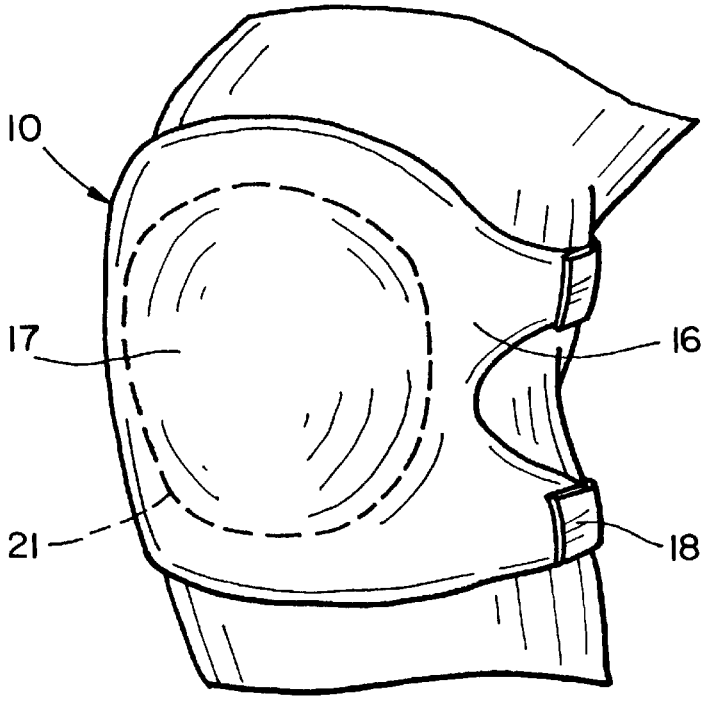
FIG. 1 is a perspective view illustrating the joint protector in accordance with one embodiment of the invention shown attached to a user's knee.
Figure 2:
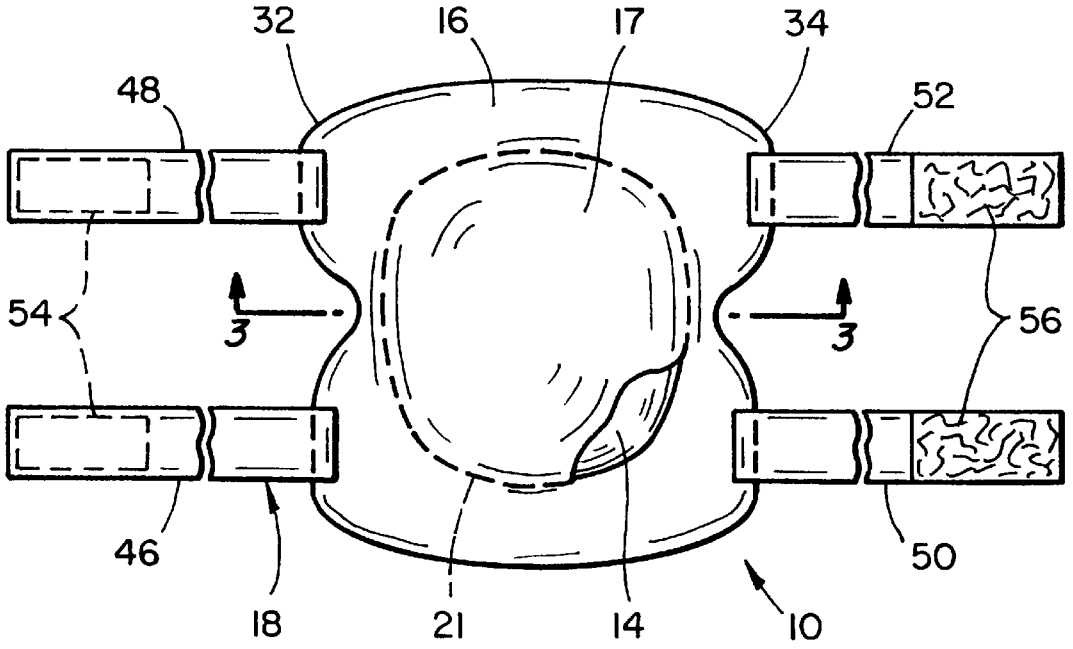
FIG. 2 is a front elevation, partially broken-away view of the joint protector of FIG. 1 showing the leg straps uncoupled and extending outwardly.
Figure 3:
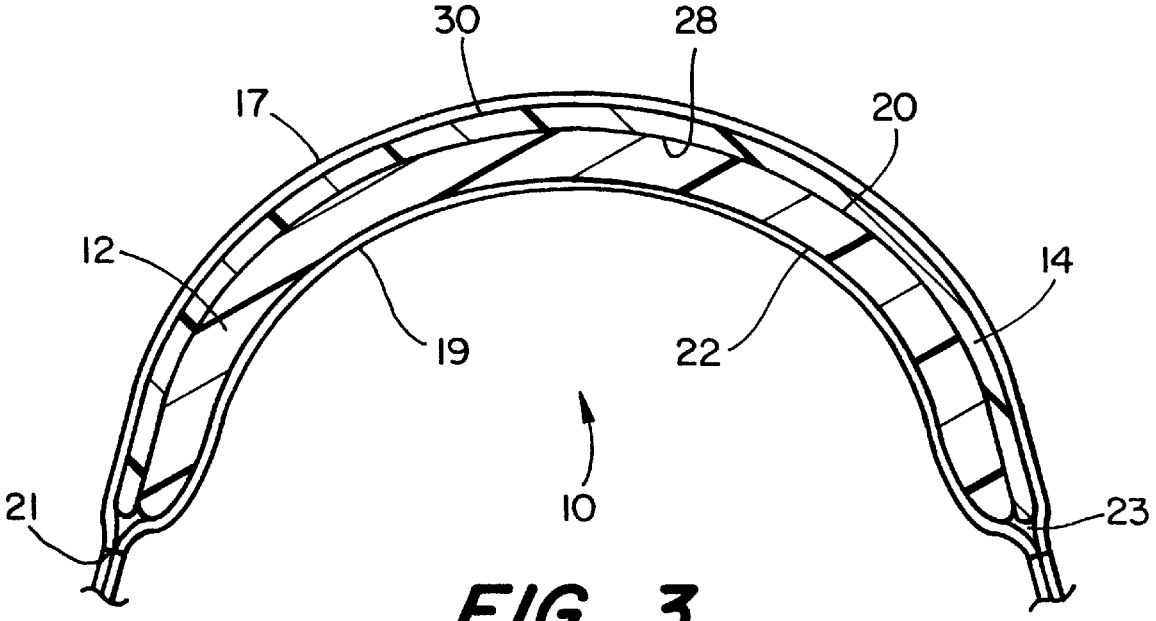
FIG. 3 is a cross sectional view, to an enlarged scale, taken along the line 3—3 of FIG. 2.
Figure 4:
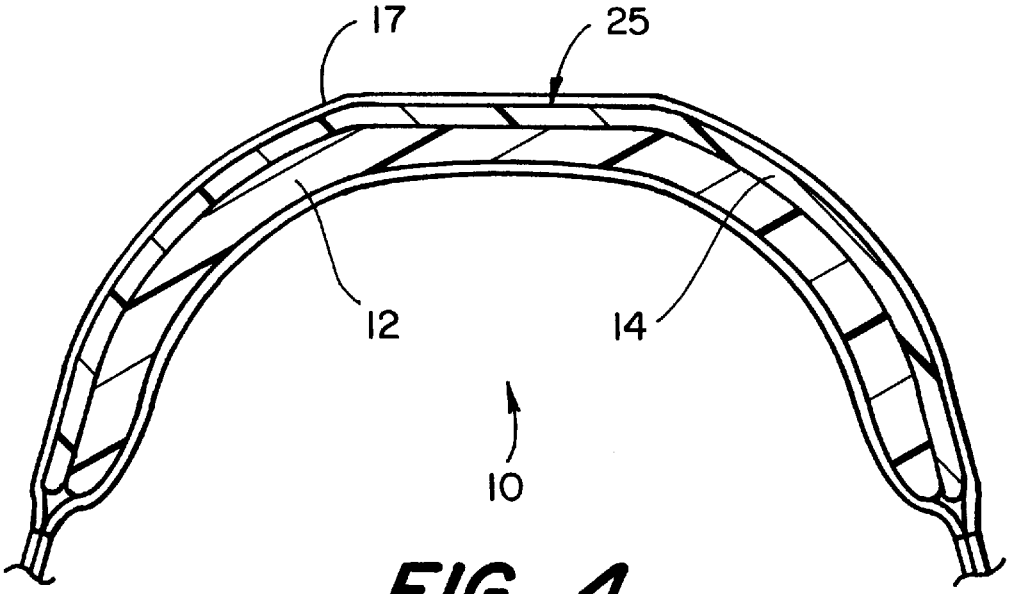
FIG. 4 is a cross sectional view similar to FIG. 3 illustrating the protector's configuration upon impact with a hard surface.

In the drawings FIGS. 1–4 illustrate generally at 10 a joint protector in accordance with one preferred embodiment of the invention. The principal components of the joint protector comprise a cushion pad 12, a semi-rigid cap 14 which is fitted over the cushion pad, a flexible cover 16 having a portion 17 which overlies the outer surface of the cap and a mechanism 18 for releasably attaching the joint protector to the user's knee or elbow.

Cushion pad 12 is formed of a material which is sufficiently soft and resilient to absorb a portion of impact forces which impact on the protector during a fall. Synthetic elastic foam plastic materials such as polyethylene foam or polyurethane foam are suitable for this purpose. The cushion pad has an outwardly convex outer surface 20 and an inwardly concave inner surface 22. Inner surface 22 is suitably shaped for fitting over either the knee or elbow anatomy, as the case may be. The thickness of cushion pad 12 is in the range of 0.25" to 1.5" and preferably 0.75".

Cap 14 is formed of a suitable elastic, compliant material. The shape of the cap can be oval as shown, or circular, rectangular or other polygonal configuration. An inner face 28 of the cap is cup-shaped to conform for fitting over outer surface 20 of the cushion pad. The outer face 30 of the cap is convex outwardly.

Cover 16 is formed of a suitable thin and flexible material such as a layer of durable fabric. Another fabric layer 19 is secured by suitable means such as the line of stitching 21 about a perimeter to form a pocket 23 behind cover portion 17. The pocket captures the cap and cushion pad to hold these components in face-to-face relationship.

The elasticity and thickness of the material which forms cap 14 are selected so that upon impact with a hard surface, such as the pavement, the cap deflects or deforms inwardly at a portion 25 around the area of impact (FIG. 4) responsive to the impact forces. Cap portion 25 deforms into conforming relationship with the pavement or other surface against which it impacts. This spreads the forces over a larger area, which is flat as in FIG. 4 when the contact surface is flat. The resiliency of the cap material is further sufficient to enable the deformed portion to elastically return to its initial shape responsive to removal of the impact forces. To provide the foregoing properties, the cap is formed of suitable synthetic polymers such as polyvinyl chloride (PVC), polyethylene and polypropylene, and the cap thickness is in the range of 2 mm to 6 mm and preferably 4 to 5 mm. The cap could be produced from the synthetic polymers by means such as injection molding.

An important feature of the embodiment of FIGS. 1–4 is in the positioning of cover 16 over the outer surface of cap 14. This serves to minimize friction between the user's apparel and the cap so that the clothing does not bunch up about the joint protector when worn beneath clothing while engaged in active sports. This enables a greater freedom of movement for the user's arms and/or legs which is highly desirable in these sports. This also obviates the problem of users who would not want to wear knee or elbow pads over their clothing, or would not want to wear the pads at all because of the foregoing problems. As a result, user safety is greatly increased.

Cover 16 further comprises wrap portions 32 and 34 (FIG. 2) which are sufficiently flexible to wrap in conformance with the sides of the user's knee or elbow, as the case may be.

Mechanism 18 for removably attaching the joint protector about the user's knee or joint preferably comprises one or more straps 46–52 attached to the opposite lateral sides of wrap portions 32 and 34. The pair of straps 46, 48 on one side are of sufficient length so that they can wrap in overlapping relationship with the corresponding pair of straps 50, 52 on the opposite side. A fastening structure comprised of complementary pads 54, 56 having layers of small hook and loop fasteners (Velcro®, for example) are secured as by stitching to facing surfaces of the pads. When the user places the pads on the straps together the overlapping hook and loop fasteners interlock to releasably hold the straps in place.

The attachment mechanism could also comprise a pull-on sleeve, not shown, made of a suitable stretchable material such as neoprene. The sleeve would replace the straps, fastener pads and wrap portion shown in FIG. 2. A cover, not shown, would be stitched or otherwise secured to the outer or inner side of the sleeve to form a closed pocket into which the cushion pad and cap would be carried. The user would put the joint protector on by merely slipping the sleeve over the leg or arm with the stretchable material being sufficiently tight-fitting to hold the protector in place.

Figure 5:
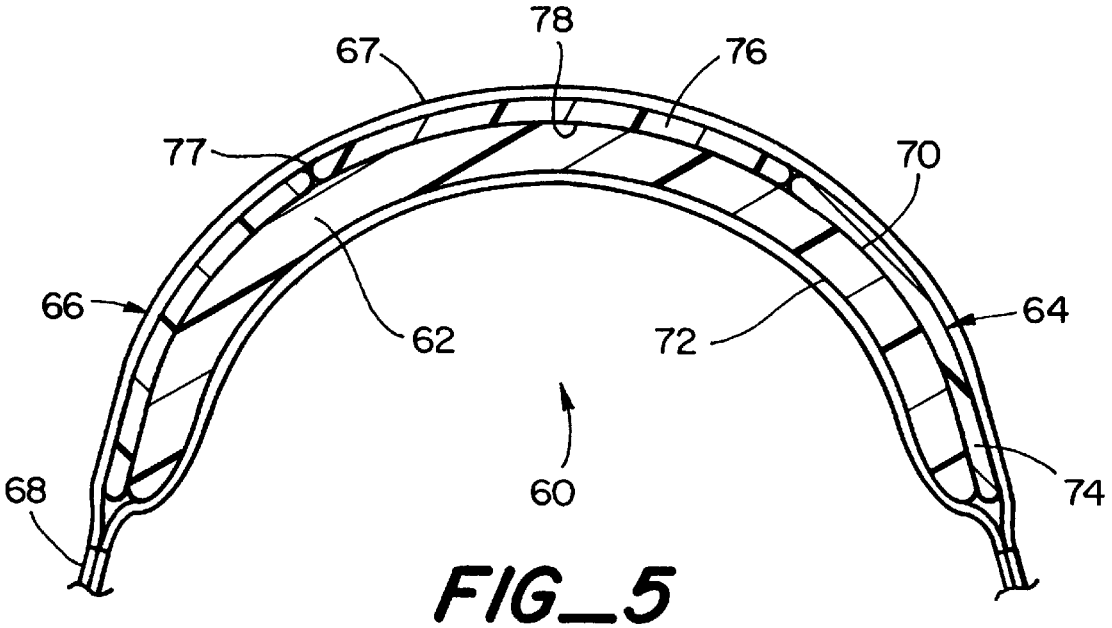
FIG. 5 is a lateral cross sectional view of a joint protector in accordance with another embodiment of the invention.
Figure 6:
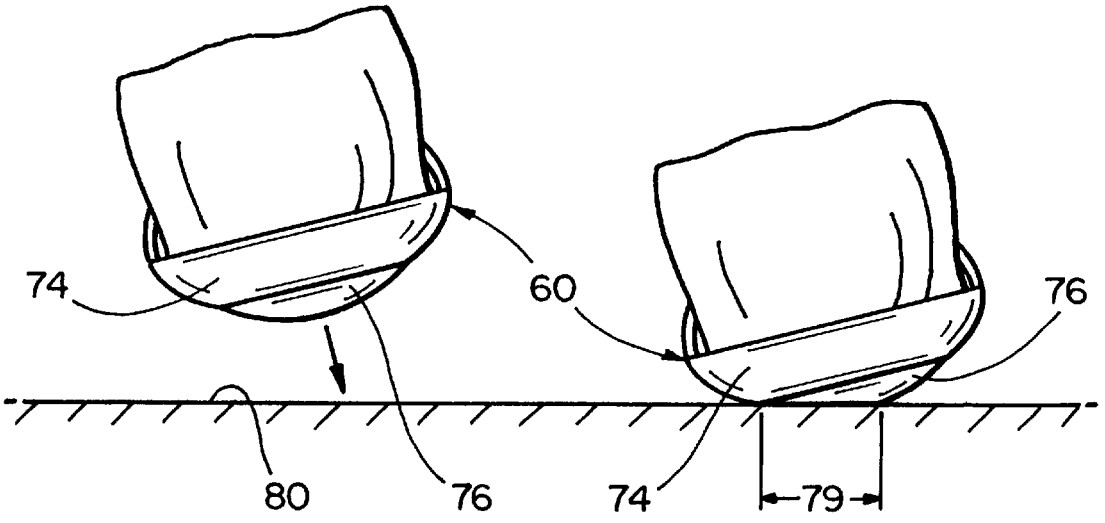
FIG. 6 is an elevation view of the joint protector of FIG. 1 shown in positions both prior to and during impact with a contact surface.

FIGS. 5–6 illustrate a joint protector 60 in accordance with another embodiment of the invention. Joint protector 60 is comprised of a cushion pad 62, a semi-rigid shell 64 which is fitted over the cushion pad, a flexible cover 66 having a portion 67 which overlies the outer surface of the shell and a mechanism 68 for releasably attaching the joint protector to the user's knee or elbow.

Cushion pad 62 is formed of a soft and resilient material, and has a thickness similar to that described for the embodiment of FIGS. 1–4. The cushion pad has an outwardly convex outer surface 70 and an inwardly convex inner surface 72.

Shell 64 is comprised of an annular support 74 and a cap 76. The support is formed of a suitable rigid or semi-rigid material, such as hard PVC, and the cap is formed of a suitable elastic, compliant material. The cap is centered within the support, and its shape can be circular, as shown, or oval, rectangular or other polygonal configuration. The support and cap are fitted together at the circular interface 77, and as desired they could be joined together at their interface by suitable means such as chemical or thermal bonding or sonic welding. An inner face 78 of the cap is cup-shaped to conform for fitting over outer surface 70 of the cushion pad.

The elasticity and thickness of the material which forms cap 76 are selected so that the cap deflects or deforms inwardly responsive to impact forces with a hard surface such as the pavement. The cap deforms into conforming relationship with the surface so that the forces are spread over a larger area. The resiliency of the cap material is further sufficient to enable it to elastically return to its initial shape responsive to removal of the impact forces. For this purpose the cap material is formed of suitable synthetic polymers such as polyvinyl chloride (PVC), polyethylene and polypropylene, and the thickness can be in the range of 2 to 6 mm and preferably 4 to 5 mm. The cap and annular support could be produced from they synthetic polymers by means such as injection molding or by thermoforming into separate parts which are then secured together by suitable means such as chemical or thermal bonding or sonic welding. The cap and support could also be made by co-injection molding processes.

When the joint protector 60 is fastened around the users knee or elbow as shown in FIG. 1, the joint, as well as any garments of the user overlying the protector, are well-protected against injury and damage. FIG. 6 shows, on the left, joint protector 60 at a position just above the ground, pavement or other contact surface 75 during a fall. When the joint protector strikes the surface, as shown on the right of the figure, the impact forces on cover 66 and cap 76 cause a portion of the cap at the area of impact to deform inwardly to a deformed, flattened (typically circular or oval) shape as shown at 79 in FIG. 6. This creates a "flat spot" in the cap at the area of impact. The deformed portion in turn transfers the impact forces to the underlying force-receiving area of the cushion pad. This obviates the problem of point loading that would occur if the shell did not sufficiently deform. By spreading out the area of impact the risk of the forces shredding cover 66 and/or tearing the leg of any pants worn by the user are obviated or minimized. Immediately after the fall after the impact force is removed, the elastic memory of the material forming the cap is sufficient to enable the cap to elastically return to its initial shape. This permits the user to recover from the fall and continue engaging in the sporting activity.

Where the joint protector of the invention is used for inline or skateboarding, then when the skater falls on either knee the point of impact is frequently toward the outside of the joint protector as shown in FIG. 6. With applicant's invention it is easier for the skater to stay upright during a sliding fall by keeping the knees underneath the skater's body. This is because the "flat spot" that is created on cap 76 around the point of impact makes it easier for the skater to keep the knee and joint protector underneath the center of gravity of his body and enable the athlete to keep himself upright. Such a flat spot would be created in the use of protectors incorporating the different embodiments. The result is that applicant's invention provides a more stable surface for the skater to slide on and maintain balance or right himself after a fall.

Figure 7:
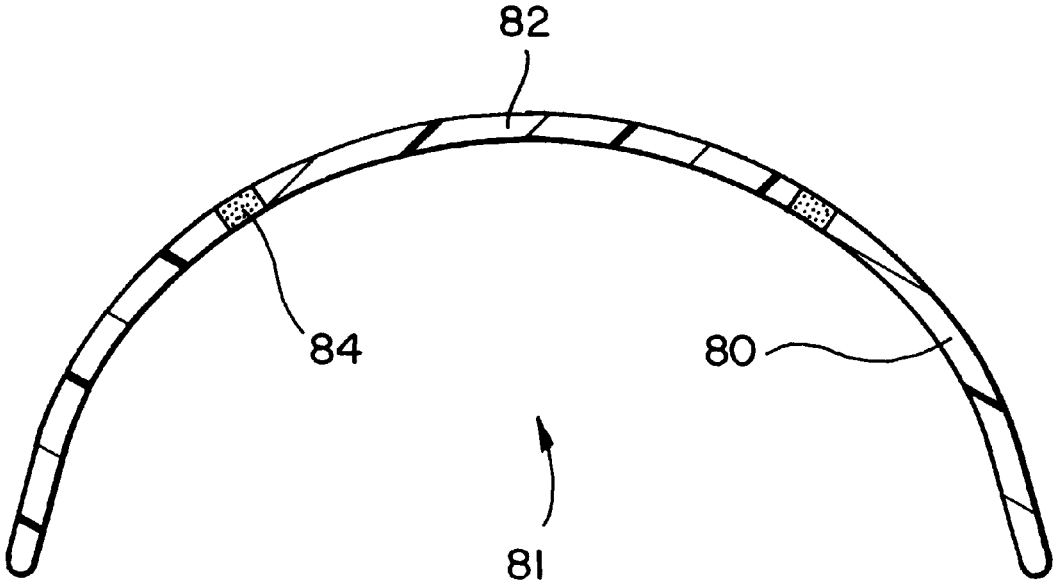
FIG. 7 is a fragmentary cross sectional view of a shell for a joint protector in accordance with another embodiment of the invention.

FIG. 7 illustrates another embodiment providing a modified semi-rigid shell 81 which can be used in combination with a cushion pad, flexible cover and release mechanism of the type described for the embodiment of FIGS. 1–4. In this embodiment semi-rigid shell 81 is comprised of a support structure 80, preferably annular, and a central cap 82 which is carried from the support structure by a co-injected annular joint 84. Cap 82 is molded of a suitable elastic, compliant material of the type described in the embodiment of FIGS. 1–4. Support structure 80 is co-injected of a suitable rigid or semi-rigid material such as hard PVC. The relatively narrow annular transition zone 84 is where the materials merge and fuse together between the support structure and deflecting portion. The cap deforms inwardly responsive to impact forces during a fall to create a "flat spot" at point of impact for the purposes explained above. The elastic memory of the cap material returns the deformed portion back to its initial position after the impact forces are removed.

Figure 8:
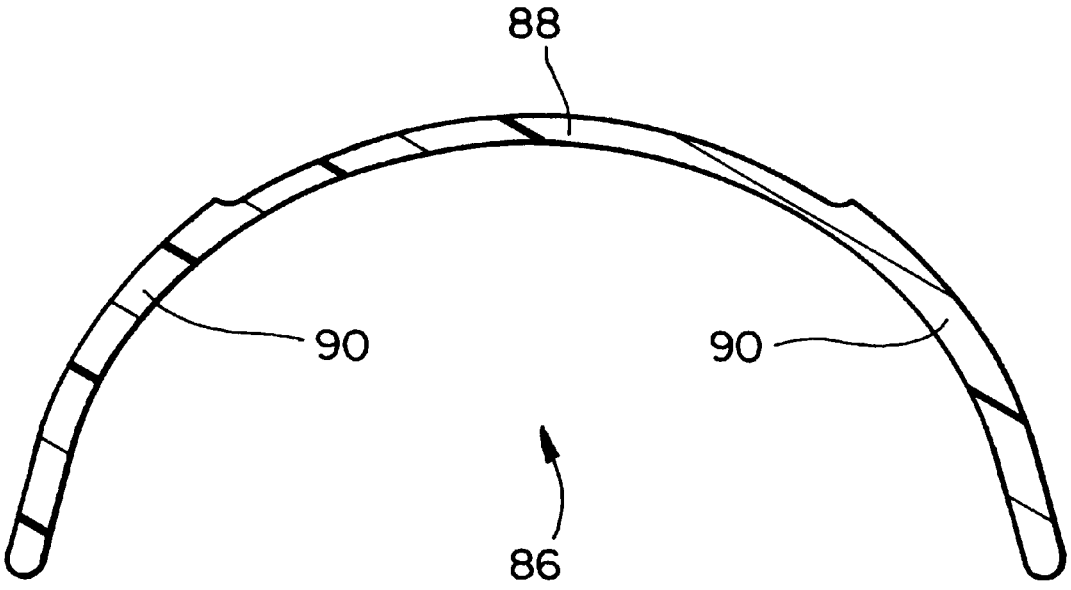
FIG. 8 is a fragmentary cross sectional view similar to FIG. 5 of a shell for a joint protector in accordance with another embodiment.

FIG. 8 illustrates another embodiment providing a shell 86 which can be used with a cushion pad, flexible cover and release mechanism as in the embodiment of FIGS. 1–4. The shell is molded of the same type of synthetic polymer material throughout, but the center portion 88 forms an integral cap which is thinner than the surrounding portion which forms annular support structure 90. The cap is sufficiently thin to enable inward and outward deformation in the manner and for the purposes explained above.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A joint protector for use in active sports for protecting a human user's knee or elbow joint from injury or protecting clothing from damage, the joint protector comprising the combination of a cushion pad having an inner surface and an outer surface, the inner surface being shaped for fitting about portions of the user's knee or elbow for attachment thereto; a cap having a cup-shaped inner face and an outwardly convex outer face, said inner face being fitted over a portion of the outer surface of the cushion pad, the cap being formed of a material which is sufficiently elastic to enable at least a portion of the cap to deform inwardly relative to the cushion pad from an initial position to a deflected position responsive to impact forces applied to an area of impact on the cap upon contact with a surface or object, said material further enabling said portion of the cap to elastically return to said initial position responsive to removal of the impact forces, a flexible cover positioned over at least a portion of the outer face of the cap, and an annular support having a central opening, the cap being supported when in the opening.

* * * * *